US005130196A

United States Patent [19]

Nishio et al.

[11] Patent Number: 5,130,196

[45] Date of Patent: Jul. 14, 1992

[54] CONJUGATE FIBERS AND FORMED PRODUCT USING THE SAME

[75] Inventors: Hiroaki Nishio; Takeshi Noma, both of Moriyama, Japan

[73] Assignee: Chisso Corporation, Nakanoshima, Japan

[21] Appl. No.: 591,508

[22] Filed: Oct. 1, 1990

[30] Foreign Application Priority Data

Oct. 2, 1989 [JP] Japan ..... 1-257326

[51] Int. Cl.[5] ..... D02G 3/00

[52] U.S. Cl. ..... 428/373; 428/374; 428/375; 428/296; 428/394; 428/198; 524/315; 524/318

[58] Field of Search ..... 428/373, 374, 375, 394, 428/296, 198; 524/318, 315

[56] References Cited

U.S. PATENT DOCUMENTS

| | | | |
|---|---|---|---|
| 3,048,263 | 8/1962 | Sacks et al. | 206/45.33 |
| 3,862,291 | 1/1975 | Brandon, Jr. et al. | 428/260 |
| 3,914,177 | 10/1975 | Nahta et al. | 428/290 |
| 4,211,819 | 7/1980 | Kunimune et al. | 428/296 |
| 4,269,888 | 5/1981 | Ejima et al. | 428/296 |
| 4,451,604 | 5/1984 | Mills | 524/312 |
| 4,522,203 | 6/1985 | Mays | 428/212 |
| 4,568,146 | 2/1986 | Ueba et al. | 428/394 |
| 4,784,909 | 11/1988 | Emi et al. | 428/372 |
| 4,785,044 | 11/1988 | Kannankeril | 524/310 |
| 4,898,771 | 2/1990 | Havens | 428/516 |
| 5,001,015 | 3/1991 | Havens | 428/516 |
| 5,036,121 | 7/1991 | Coaker et al. | 428/378 |

*Primary Examiner*—George F. Lesmes
*Assistant Examiner*—Beverly A. Pawlikowski
*Attorney, Agent, or Firm*—Fay, Sharpe, Beall, Fagan, Minnich & McKee

[57] ABSTRACT

Easily processable, polyolefin hot-melt adhesive conjugate fibers which are unnecessary to apply any oiling agent at the time of spinning and drawing steps, and a formed product such as non-woven fabric, filter for water treatment, etc. obtained by heat-treating the conjugate fibers are provided, which conjugate fibers comprise polyolefin hot-melt adhesive conjugate fibers composed of two different kinds of polyolefins having different melting points by 20° C. or more and constituted so that the lower melting polyolefin can occupy at least one portion of the fiber surface, the lower melting polyolefin having monoglyceride of 12C or more fatty acid in 3 to 10 weight % incorporated thereinto.

7 Claims, No Drawings

CONJUGATE FIBERS AND FORMED PRODUCT USING THE SAME

BACKGROUND OF THE INVENTION

1. Field of the Invention

This invention relates to hot-melt adhesive, conjugate fibers composed of polyolefines and a formed product using the same. More particularly, it relates to easily processable fibers needing no oiling agent applied at the spinning and drawing steps thereof, and formed products using the same such as non-woven fabric, filter for water treatment, etc. obtained by heat-treating the fibers.

2. Description of the Related Art

Formed products obtained by heat-treating hot-melt adhesive, conjugate fibers consisting of polyolefins having different melting points such as a combination of polypropylene with polyethylene, etc. and fixing the contact points of the fibers by melt-adhesion of the low-melting component, have superior mechanical properties and chemical resistance. Thus, they have been used for water-treating filter or non-woven fabric in various fields. In general, fibers composed of thermoplastic resins having a surfactant coated thereon as an oiling agent in order to prevent the friction and static charge of the fibers at the time of spinning or drawing, carding and the like steps, but the surfactant remains in formed products prepared using such fibers. Thus, when such products are used for water-treating filter, there have been raised problems that a high concentration of the surfactant exudes out into the resulting filtrate at the initial period of its use to cause bubbling in the filtrate and particularly in the field of foods, contamination by the surfactant occurs.

SUMMARY OF THE INVENTION

An object of the present invention is to provide an easily processable hot-melt adhesive conjugate fibers capable of affording a formed product, preventing it from exuding-out of surfactant, while retaining superior processability at spinning, drawing, carding and the like steps.

Another object is to provide a formed product using the above hot-melt adhesive conjugate fibers.

The present inventors have made extensive research in order to achieve the above-mentioned objects, and have found that when polyolefin hot-melt adhesive conjugate fibers composed of at least two polyolefin components having different melting points are prepared, monoglyceride of a fatty acid of 12 carbon atoms or more in 3 to 10% by weight is incorporated into the polyolefin having a lower melting point and conjugate-spinning is carried out so that the polyolefin having a low melting point can occupy at least one portion of the resulting fiber surface, to achieve the aimed objects, and have completed the present invention.

The present invention has the following constitutions:

(1) Hot-melt adhesive conjugate fibers composed of two different kinds of polyolefins having different melting points by 20° C. or more and constructed so that the polyolefin having a lower melting point can occupy at least one portion of the fiber surface, said polyolefin having a lower melting point containing monoglyceride of a fatty acid of 12 carbon atoms or more in 3 to 10% by weight incorporated thereinto.

(2) A formed product obtained by heat-treating conjugate fibers as set forth in item (1) at a melting point or higher of said polyolefin having a lower melting point and at a temperature lower than the melting point of the other polyolefin having a higher melting point, and having the contact points of the fibers fixed by melt-adhesion of said polyolefin having a lower melting point.

DETAILED DESCRIPTION OF PREFERRED EMBODIMENTS

As the polyolefin having a higher melting point in the present invention, usual crystalline polypropylene may be used. For example, propylene homopolymer, copolymers composed mainly of propylene and containing copolymerizable component(s) such as ethylene, butene-1, etc. and mixtures of thereof may be used.

As the polyolefin having a lower melting point in the present invention, a polyolefin having a melting point lower by 20° C. or more than that of the above polyolefin having a higher melting point such as high density polyethylene, low density polyethylene, linear low density polyethylene, ethylene-vinyl acetate copolymer, etc., may be used.

If the difference between the melting points of the two kinds of polyolefins is less than 20° C., the tolerable range of the heat-treating temperature at the time of production of the formed product becomes narrow.

As the monoglyceride of a fatty acid to be incorporated into the polyolefin having a lower melting point, used for the hot-melt adhesive conjugate fibers, monoglycerides of lauric acid, stearic acid, oleic acid, etc. may be exemplified and they may be used alone or in admixture. If the quantity of the monoglyceride incorporated into the polyolefin having a lower melting point is less than 3%, the resulting hot-melt adhesive conjugate fibers have a high friction to cause troubles such as twining around the rolls at the time of spinning and drawing steps and inferior passage through card due to static charge, while if the quantity exceeds 10%, the melt-spinning of the hot-melt adhesive conjugate fibers will be inferior. Therefore, satisfactory spinning is impossible.

In order to incorporate the monoglyceride into the polyolefin having a lower melting point, any conventional methods are employed such as blending, kneading, etc., which are easily conducted by an extruder, for example.

The hot-melt adhesive conjugate fibers of the present invention are obtained by conjugate-spinning the above two kinds of polyolefins into the form of side-by-side or sheath-and-core so that the polyolefin having a lower melting point having the above monoglceride incorporated therein can occupy at least one portion of the fiber surface continuously in the length direction. In the case of conjugate-spinning into the form of sheath-and-core, the polyolefin having a lower melting point is used as the sheath component. The ratio of both the components is preferably in the range of 70/30 to 30/70 (ratio by weight). If the ratio of the polyolefin having a lower melting point is less than 30%, the resulting product obtained by heat-treatment has an insufficient adhesion strength between the fibers thereof, while if the ratio of the thermoplastic resin having a high melting point is less than 30%, the strength of the fibers themselves is insufficient. Thus, the strength of the resulting product is insufficient in either of the cases.

EXAMPLE

The present invention will be described in more detail by way of Examples and Comparative examples. The definitions of the technical terms and the test method of the physical properties employed in these examples are described as follows:

Spinnability: a product which causes single fiber break once or more for 10 minutes is regarded as bad and designated by a symbol of x, and a product which causes single fiber break less than once for 10 minutes is regarded as good and designated by a symbol of o.

Fiber strength: measured at a gripping distance of 20 cm and at a tensile rate of 20 cm/min. according to the testing method for tensile strength of JIS L1013 (testing method for chemical fiber filament yarn); and a product having a break strength of 2 g/d or more was regarded as good and designated by a symbol of o and a product having a break strength less than 2 g/d was regarded as bad and designated by a symbol of x.

Charging properties: making up sample staple fibers into a web by means of a roll carding machine and measuring the static voltage of the web just after having left a doffer roll by means of a collecting type potential measurement instrument (room temperature 20° C.; humidity: 65%). A product having a static charge exceeding 1.2 KV was wound around a cylinder or a doffer roll and hence not suitable to practical use.

Bubbling properties: a sample filter was set to a filtration tester, followed by passing water through the tester at a rate of 2,000 l/hr, collecting the first filtrate water (50 ml) in a 200 ml graduated test tube, plugging the tube, shaking it one hundred times and allowing it to stand for one minute. A product in the case where bubbles are still remaining at that time was regarded as bad.

Filtering test: a sample filter was set to a filtration tester, attached to a stock solution tank, followed by passing water through the filter at a rate of 2,000 l/hr adding active carbon (Shirasagi C®; 43 microns or less, 80%) (0.5 g), polishing finely-divided powder (FO #1200 (tradename); 5 to 15 microns, 90%) (1 g) and carborundum (#220; 35 to 100 microns, 90%) (0.5 g), thereafter taking 100 ml of the resulting filtrate and collecting passed particles on a precise filter paper by suction filtration. The particle diameter was measured by a microscope and the largest particle diameter was recorded. Filterability is defined as the adaptability of a liquid-solid system to filtration. The system is not filterable if it is too viscous to be forced through a filter mediam.

EXAMPLES 1 TO 5 AND COMPARATIVE EXAMPLES 1 TO 4

A high density polyethylene (melt flow rate 25, g/min , 190° C.) and the respective surfactants of the kinds and quantities shown in Table 1 were fed into a first extruder, and a crystalline polypropylene (melt flow rate 35, g/min , 230° C.) was fed into a second extruder, followed by conjugate-spinning by means of a conjugate spinning die of side-by-side type (hole number: 100), the extrusion rate and the extrusion temperature of both the extruders being 6,000 g/hr and 250° C., respectively, to obtain undrawn filaments of 60 d/f. These undrawn filaments were drawn to 3.2 times the original length, followed by subjecting the resulting filaments to mechanical crimping of 12 crimps/25 mm and cutting to a cut length of 64 mm to obtain staple fibers of 19 d/f.

The staple fibers were made up into a web having a basis weight of 20 g/m$^2$ and a width of 800 mm by means of a roll-carding machine, followed by sending this web horizontally, while heating it successively from its end to 140° to 150° C. by means of a far infrared rays heater, winding up the resulting web by the length of 48 meters in a state where only the polyethylene was melted, around the core of a stainless steel pipe (outer diameter: 30 mm, weight: 4 Kg/m), under a pressure of its own weight of the wound materila, cooling and cutting, to obtain a hollow, cylindrical, formed product having a length of 250 mm, an outer diameter of 70 mm and a weight of 240 g. This formed product was used as a filter element and its bubbling properties and filtering properties are tested. The tested results are shown together in Table 1.

EXAMPLES 6 AND 7

Example 1 was repeated except that only the fineness of the filaments was varied, to examine spinnability, fiber strength, charging properties, bubbling properties and filtering properties. These test results are shown together in Table 1.

COMPARATIVE EXAMPLES 5 and 6

Using the same polypropylene and polyethylene as in Example 1 but without adding any surfactant to the polyethylene, conjugate spinning of side-by-side type was carried out as in Example 1 or Example 7, attaching polyoxyethylene adduct of sorbitan-monooleate as a spining oil onto the resulting conjugate fibers (0.2% by weight), to obtain staple fibers of 19 deniers (Comparative example 5) and 3 deniers (Comparative example 6). These staple fibers were treated as in Example 1 to prepare hollow, cylindrical, formed products. The test results are shown together in Table 1.

TABLE 1

| | Surfactant | Added amount (%) | Spinnability | Fiber strength | Fineness (d/f) | Static electricity generated in carding (KV) | Bubbling (ml) | Filterability (μm) |
|---|---|---|---|---|---|---|---|---|
| Ex. 1 | Stearic acid monoglyceride | 3 | o | o | 19 | 0.8~1.2 | 0 | 50 |
| Ex. 2 | " | 5 | o | o | 19 | 0.5~1.0 | 0 | 50 |
| Ex. 3 | " | 10 | o | o | 19 | 0.4~0.8 | 0 | 50 |
| Ex. 4 | " | 5 | o | o | 19 | 0.5~1.1 | 0 | 50 |
| Ex. 5 | Oleic acid monoglyceride | 5 | o | o | 19 | 0.6~1.1 | 0 | 50 |
| Ex. 6 | Stearic acid monoglyceride | 5 | o | o | 6 | 0.5~1.0 | 0 | 10 |
| Ex. 7 | " | 5 | o | o | 3 | 0.5~1.0 | 0 | 5 |
| Comp. ex. 1 | Stearic acid monoglyceride | 1 | o | o | 19 | 5~10 *2 | — | — |

TABLE 1-continued

| | Surfactant | Added amount (%) | Spinn-ability | Fiber strength | Fineness (d/f) | Static electricity generated in carding (KV) | Bubbling (ml) | Filterability (μm) |
|---|---|---|---|---|---|---|---|---|
| Comp. ex. 2 | " | 13 | x | x | — | — | — | — |
| Comp. ex. 3 | Sorbitan monooleate.POE | 0.25 | ○ | ○ | 19 | 10~20 *2 | — | — |
| Comp. ex. 4 | No addition | 0 | ○ | ○ | 19 | 20~25 *2 | — | — |
| Comp. ex. 5 | Sorbitan monooleate.POE | *1 | ○ | ○ | 19 | 0.05~0.1 | 40 | 50 |
| Comp. ex. 6 | Sorbitan monooleate.POE | *1 | ○ | ○ | 3 | 0.05~0.2 | 40 | 5 |

Footnote *1: Oiling agent attached 0.25% by weight. *2: Carding passage, bad.

Apparent from the data shown in Table 1, the hot-melt adhesive conjugate fibers having a specified surfactant incorporated therein, according to the present invention, have sufficient spinnability and low charge even when no surfactant is applied to the fibers, and when a formed product obtained from the above fibers is used as filters, no bubbling occurs in the filtrate and also similar ability of retaining fine particles to that conventional product is attained. Whereas, fibers having no surfactant incorporated thereinto have a strong charge, and it is difficult to form them into a web or obtain a formed product, while fibers having a surfactant incorporated therein in excess is inferior in spinnability. Further, fibers having a surfactant applied thereonto give a product having an intense bubbling properties of the filtrate, and cannot be applied to practical use.

What we claim is:

1. Hot-melt adhesive conjugate fibers composed of two different kinds of polyolefins having different melting points, the lower melting point polyolefin having a melting point of at least 20° C. less than the higher melting point polyolefin and constituted so that the polyolefin having the lower melting point can occupy at least one portion of the fiber surface, said polyolefin having the lower melting point having monoglyceride of a fatty acid of 12 carbon atoms or more at 3 to 10% by weight of the lower melting point polyolefin component incorporated thereinto.

2. Hot-melt adhesive conjugate fibers according to claim 1, wherein said polyolefin having the lower melting point is selected from the group consisting of high density polyethylene, low density polyethylene, linear low density polyethylene and ethylenevinyl acetate copolymer.

3. Hot-melt adhesive conjugate fibers according to claim 1, where the polyolefin having the melting point higher than said polyolefin having the lower melting point by 20° C. or more is selected from the group consisting of propylene homopolymer and copolymer composed of propylene and copolymerizable components consisting of ethylene or butene-1.

4. Hot-melt adhesive conjugate fibers according to claim 1, wherein said monoglyceride of a fatty acid is selected from the group consisting of glycerides of lauric acid, stearic acid and oleic acid.

5. Hot-melt adhesive conjugate fibers according to claim 1, wherein said conjugate fiber is obtained by conjugate-spinning said two kinds of polyolefins to form a side-by-side conjugate fiber or a sheath-and-core conjugate fiber so that the polyolefin having the lower melting point having the above monoglyceride incorporated therein can occupy at least a portion of the fiber surface continuously in the length direction.

6. A formed product obtained by heat-treating the fibers as set forth in claim 1 at a temperature the same as the melting point or higher of said polyolefin having the lower melting point and at a temperature lower than the melting point of the other polyolefin having the higher melting point, and having the contact points of the fibers fixed by melt-adhesion of said polyolefin having the lower melting point.

7. Hot-melt adhesive conjugate fibers according to claim 1, wherein a ratio of the high melting point polyolefin to the low melting point polyolefin is in the range of 30/70 to 70/30.

* * * * *